US010519911B2

(12) United States Patent
Shaull et al.

(10) Patent No.: US 10,519,911 B2
(45) Date of Patent: Dec. 31, 2019

(54) COMMON RAIL MULTI-CYLINDER FUEL PUMP WITH INDEPENDENT PUMPING PLUNGER EXTENSION

(71) Applicant: CUMMINS INC., Columbus, IN (US)

(72) Inventors: Anthony A. Shaull, Columbus, IN (US); Lester L. Peters, Columbus, IN (US); Brian M. Watson, Columbus, IN (US); Roberto M. Munoz, Columbus, IN (US)

(73) Assignee: Cummins Inc., Columbus, IN (US)

( * ) Notice: Subject to any disclaimer, the term of this patent is extended or adjusted under 35 U.S.C. 154(b) by 13 days.

(21) Appl. No.: 15/571,127

(22) PCT Filed: May 14, 2015

(86) PCT No.: PCT/US2015/030712
§ 371 (c)(1),
(2) Date: Nov. 1, 2017

(87) PCT Pub. No.: WO2016/182572
PCT Pub. Date: Nov. 17, 2016

(65) Prior Publication Data
US 2018/0171949 A1 Jun. 21, 2018

(51) Int. Cl.
*F02M 59/10* (2006.01)
*F02M 59/08* (2006.01)
(Continued)

(52) U.S. Cl.
CPC ..... *F02M 59/102* (2013.01); *F02M 59/08* (2013.01); *F02M 59/442* (2013.01);
(Continued)

(58) Field of Classification Search
CPC ..... F02M 59/08; F02M 59/102; F04B 1/0426
See application file for complete search history.

(56) References Cited

U.S. PATENT DOCUMENTS 2,849,997 A * 9/1958 Kravits ..... F02M 59/00 123/495
3,004,496 A * 10/1961 Minett ..... F02M 59/00 417/569

(Continued)

OTHER PUBLICATIONS

International Search Report and Written Opinion dated Aug. 21, 2015 in PCT/US2015/030712.

*Primary Examiner* — F Daniel Lopez
*Assistant Examiner* — Michael Quandt
(74) *Attorney, Agent, or Firm* — Faegre Baker Daniels LLP

(57) ABSTRACT

A fuel pump for an internal combustion engine is provided comprising a barrel including a central bore having a longitudinal axis, a plunger disposed partially in the central bore and movable along the longitudinal axis, a spring retainer, a first coil spring having a proximal end in contact with a first section of the barrel and a distal end in contact with the spring retainer to urge the spring retainer into engagement with a tappet assembly, an extender element coupled to the plunger, and a second coil spring having a proximal end in contact with a second section of the barrel and a distal end in contact with the extender element to urge the plunger toward the spring retainer, wherein the extender element includes a counter-bore to couple the extender element to the plunger.

21 Claims, 8 Drawing Sheets

(51) Int. Cl.

| | |
|---|---|
| ***F04B 1/04*** | (2006.01) |
| ***F02M 59/48*** | (2006.01) |
| ***F02M 59/44*** | (2006.01) |
| ***F04B 9/04*** | (2006.01) |

(52) U.S. Cl.
CPC ..... *F02M 59/48* (2013.01); *F04B 1/0413* (2013.01); *F04B 1/0426* (2013.01); *F04B 1/0531* (2013.01); *F04B 1/0536* (2013.01); *F04B 9/042* (2013.01); *F02M 2700/1317* (2013.01)

(56) References Cited

U.S. PATENT DOCUMENTS

| | | | | |
|---|---|---|---|---|
| 6,439,204 | B1 * | 8/2002 | Duquette | F02M 39/00 123/506 |
| 7,311,087 | B2 * | 12/2007 | Shaull | F02M 59/102 123/495 |
| 7,513,756 | B2 * | 4/2009 | Aoki | F02M 47/027 417/470 |
| 8,495,987 | B2 * | 7/2013 | Lucas | F02M 59/102 123/495 |
| 2002/0053282 | A1 | 5/2002 | Duquette et al. | |
| 2005/0106035 | A1 | 5/2005 | Aoki et al. | |
| 2006/0110273 | A1 | 5/2006 | Shaull et al. | |
| 2007/0217927 | A1 | 9/2007 | Tansug et al. | |
| 2010/0226795 | A1 * | 9/2010 | Shaull | F04B 53/04 417/290 |
| 2011/0052427 | A1 * | 3/2011 | Shaull | F02M 59/102 417/364 |
| 2011/0303195 | A1 | 12/2011 | Lucas et al. | |

* cited by examiner

COMMON RAIL MULTI-CYLINDER FUEL PUMP WITH INDEPENDENT PUMPING PLUNGER EXTENSION

RELATED APPLICATIONS

The present application is a national phase filing under 35 U.S.C. § 371 of International Application No. PCT/US2015/030712, titled "COMMON RAIL MULTI-CYLINDER FUEL PUMP WITH INDEPENDENT PUMPING PLUNGER EXTENSION," filed on May 14, 2015, the entire disclosure of which being expressly incorporated herein by reference.

FIELD OF THE DISCLOSURE

The present disclosure generally relates to a common rail multi-cylinder fuel pump for an internal combustion engine. More specifically, this disclosure relates to a common rail multi-cylinder fuel pump with independent pumping plunger extension to protect against progressive engine damage due to plunger sticking or seizing.

BACKGROUND OF THE DISCLOSURE

Cam driven high pressure fuel pumps have become a common solution for generating high pressure fuel in common rails utilized in direct injection internal combustion engines. Fuel pumps typically include pumping elements that comprise a pumping plunger reciprocating within a bore. These fuel pumps are typically driven by a tappet mounted adjacent to a cam for cyclically pushing on the actuated end of the pumping plunger. The pumping plunger's reciprocating motion is typically accomplished with a mechanism that moves the plunger with a rotating cam. For typical pumping operations the overall reciprocating mass of the pump system is manageable with a single return spring mounted at a lower section of the fuel pump. This spring directly returns the pumping plunger and the plunger simultaneously returns the tappet. The conventional plunger return spring is located between the pump body and a spring seat or spring retainer mounted on the actuated end of the pumping plunger. As is known in the art, pumping plungers are susceptible to seizure during high pressure pumping operations due to, for example, increased plunger thermal loads, debris build up within the bore which houses the plunger, or inadvertent side loading of the plunger. As such, a need exists for a pumping element that separates the plunger extension function and the tappet preload function by, for example, adding an additional spring and an extender element which enables a seized plunger to un-seize and continue normal operation thereby avoiding engine downtime. A need further exists for an extender element having a design which reduces the pressurization and flow of fluid into the plunger bore during reciprocal movement of the pumping plunger.

SUMMARY OF THE DISCLOSURE

In one embodiment of the present disclosure a fuel pump is provided comprising, a barrel including a central bore having a longitudinal axis; a plunger disposed partially in the central bore and movable along the longitudinal axis; a spring retainer; a first coil spring having a proximal end in contact with a first section of the barrel and a distal end in contact with the spring retainer to urge the spring retainer into engagement with a tappet assembly; an extender element coupled to the plunger; and a second coil spring having a proximal end in contact with a second section of the barrel and a distal end in contact with the extender element to urge the plunger toward the spring retainer, wherein the extender element includes a counter-bore to couple the extender element to the plunger. In one aspect of this embodiment the extender element includes a plurality of vent holes that are concentrically arranged, the vent holes structured to reduce flow of fluid into the central bore during reciprocal movement of the plunger. In a variant of this aspect the extender element includes a first slot having a first diameter and a second slot having a second diameter, the first diameter being larger than the second diameter and the plunger includes a first section having a first diameter and a second section having a second diameter, the first diameter being larger than the second diameter. In a variant of this variant, the first section of the plunger is received by the first slot of the extender element and the second section of the plunger is received by the second slot of the extender element such that the extender element is securely coupled to the plunger.

In another aspect of this embodiment, the barrel includes a proximal end and a distal end, the proximal end including a first section having a first diameter and a second section having a second diameter, the second diameter being larger than the first diameter, wherein at least one coil of the second coil spring contacts the second section. In a variant of this aspect the barrel includes a third section having a third diameter, the third diameter being larger than the first diameter and the second diameter of the barrel and at least one coil of the first coil spring contacts the third section. In a variant of this variant the extender element is coupled to the plunger via an interference fit and during reciprocal movement of the plunger, the plunger extends away from the distal end of the barrel such that a lengthwise portion of the plunger is disposed in the central bore. In another aspect of this embodiment, the fuel pump further includes at least a first pumping chamber and a second pumping chamber wherein an air vent is disposed intermediate the first and second pumping chambers.

In another embodiment of the present disclosure a fuel pump is provided comprising, a barrel including a central bore having a longitudinal axis; a plunger disposed in the central bore and movable along the longitudinal axis; a first coil spring guided by a first section of the barrel wherein the first coil spring surrounds a first portion of the central bore; a second coil spring guided by a second section of the barrel wherein the second coil spring surrounds a second portion of the central bore that is smaller than the first portion; a spring retainer in contact with a tappet assembly, the spring retainer including a sidewall that receives a portion of the first coil spring; and an extender element coupled to the plunger, the extender element including a sidewall that receives a portion of the second coil spring, wherein the extender element cooperates with the second coil spring to urge the plunger out of seized interference within the central bore.

In one aspect of this embodiment the extender element includes a counter-bore to couple the extender element to the plunger. In another aspect of this embodiment the extender element includes a plurality of vent holes that are concentrically arranged, the vent holes structured to reduce flow of fluid into the central bore during reciprocal movement of the plunger. In yet another aspect of this embodiment, the extender element includes a first slot having a first diameter and a second slot having a second diameter, the first diameter being larger than the second diameter and the plunger includes a first section having a first diameter and a second section having a second diameter, the first diameter being larger than the second diameter. In a variant of this aspect, the first section of the plunger is received by the first slot of the extender element and the second section of the plunger is received by the second slot of the extender element such that the extender element is securely coupled to the plunger. In yet another aspect of this embodiment, the tappet assembly includes a tappet shell to receive the spring retainer, a plurality of coils of the first coil spring and a plurality of coils of the second spring, and the spring retainer includes at least two fluid drain passages to drain fluid towards a roller element partially disposed within the tappet assembly. In yet another aspect of this embodiment, the fuel pump further includes a fuel drain port to drain excess fuel to a fuel tank of an internal combustion engine in response to reciprocal movement of the plunger. In yet another aspect of this embodiment, the extender element further includes a disc section having a surface wherein the sidewall is perpendicular to the surface and the disc section is engaged by a portion of the second coil spring.

In another embodiment of the present disclosure a method in a fuel pump is provided comprising, reciprocally moving a plunger within a central bore of a barrel along a longitudinal axis; guiding a first coil spring by a first section of the barrel, wherein the first coil spring surrounds a first portion of the central bore; guiding a second coil spring by a second section of the barrel, wherein the second coil spring surrounds a second portion of the central bore that is smaller than the first portion; biasing a spring retainer toward a tappet by the first coil spring, wherein the spring retainer includes a sidewall, a portion of the first coil spring being engaged by the sidewall; and biasing an extender element toward the tappet by the second coil spring, wherein the extender element is coupled to the plunger and biasing the extender element toward the tappet urges the plunger out of seized interference within the central bore. In one aspect of this embodiment, the method further includes, reducing, by a plurality of vent holes, the flow of fluid within the central bore during reciprocal movement of the plunger, wherein the plurality of vent holes are concentrically arranged within the extender element. In another aspect of this embodiment the method further includes draining, by a fuel drain port, excess fuel to a fuel tank of an internal combustion engine, wherein the draining occurs in response to reciprocal movement of the plunger. In yet another aspect of this embodiment the method further includes draining fluid towards a roller element partially disposed within the tappet, wherein the draining is enabled by at least two fluid drain passages disposed within the spring retainer.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF EMBODIMENTS

The embodiments disclosed herein are not intended to be exhaustive or to limit the disclosure to the precise forms disclosed in the following detailed description. Rather, the embodiments were chosen and described so that others skilled in the art may utilize their teachings.

Figure 1:
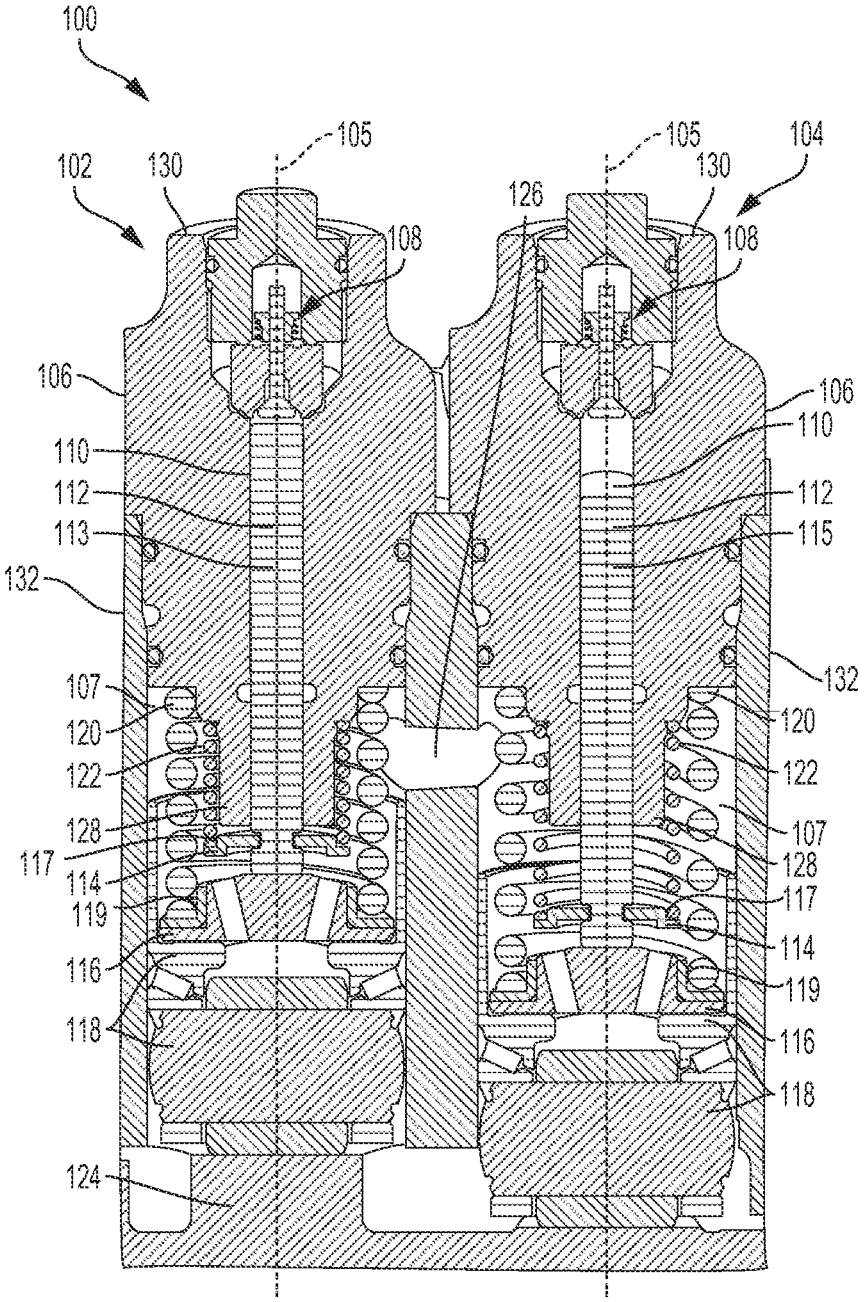
FIG. 1 is a cross-sectional view of exemplary pumping elements according to the present disclosure.

FIG. 1 is a cross-sectional view of exemplary pumping elements according to the present disclosure. Fuel pump 100 includes first pumping element 102 and second pumping element 104. Second pumping element 104 includes substantially the same components as first pumping element 104 such that multiple components are identical between the two pumping elements. As shown in the illustrative embodiments of FIG. 1, the same reference numbers are used in the description of components which are identical between pumping element 102 and pumping element 104. As such, a description of the components of first pumping element 102 that have a corresponding identical component within pumping element 104 will apply as a description of the corresponding identical component. For example, a description of component 1xx within pumping element 102 will likewise apply as a description of component 1xx within pumping element 104. Additionally, although two pumping elements are shown, in various alternative embodiments of the present disclosure fuel pump 100 may include multiple pumping elements configured to operate simultaneously to pump pressurized fuel to a fuel rail or accumulator of an internal combustion engine.

In the disclosed embodiment of FIG. 1, pumping elements 102, 104 are arranged within a fuel pump 100 and structured to facilitate the pumping of fuel into a common fuel rail (not shown) of a fuel system of an internal combustion engine (not shown) wherein the common fuel rail supplies pressurized fuel to one or more fuel injectors (not shown) during operation of an internal combustion engine. Other exemplary fuel pumps, various components of the internal combustion engine, as well as mechanical and electrical operation of exemplary fuel systems are described in U.S. Patent Application Publication No. 2014/0193281 A1 published on 10 Jul. 2014, the entire disclosure of which is hereby expressly incorporated herein by reference. Upon review of U.S. Patent Application Publication No. 2014/0193281 A1, those of ordinary skill in the art will understand the description of the internal combustion engine and will further understand the description of fuel system component functionality provided therein. Moreover, those of ordinary skill in the art will further understand how pumping elements 102, 104 may facilitate the pumping of high pressure fuel within one or more of the disclosed exemplary fuel systems provided therein.

Fuel pump 100 generally includes barrel 106, tappet bore 107, inlet check valve 108, plunger bore 110, pumping plunger 112, extender element 114, spring retainer 116, tappet assembly 118, tappet return spring 120, plunger return spring 122, cam lobe 124, and vent-hole 126. Barrel 106 includes distal end 130 and proximal end 128. Barrel 106 further includes plunger bore 110 disposed centrally therein along a longitudinal axis 105 thereof. Pumping plunger 112 is disposed within plunger bore 110 and structured for reciprocal movement therein. In various embodiments of the present disclosure, pumping plunger 112 may be substantially but not completely disposed within plunger bore 110 so that during reciprocal movement within plunger bore 110, at least a portion of plunger 112 is extends outside of plunger bore 110. In various embodiments, pumping plunger 112 is moveable between a pumping stroke 113 and a filling stroke 115. In the illustrative embodiment of FIG. 1, pumping plunger 112 of pumping element 102 is shown in a pumping stroke 113 position while pumping plunger 112 of pumping element 104 is shown in a filling stroke 115 position. Barrel 106 further includes inlet check valve 108 disposed generally longitudinally above pumping plunger 112. As is known in the art, inlet check valve 108 is generally configured to permit low pressure inlet fuel to enter pumping element 102, 104 at a filling pressure of approximately 150 pounds per square inch (psi).

In various embodiments of the present disclosure, while pumping plunger 112 is in a filling stroke 115 position, inlet check valve 108 permits pressurized inlet fuel to fill plunger bore 110 so that the pressurized fuel fills a volume of space defined at one end by pumping plunger 112. Longitudinal movement of plunger 112 away from cam lobe 124 causes compression or pressurization of fuel in plunger bore 110 and creates a pressure stroke (i.e. pumping stroke 113) causing fuel to exit pumping element 102, 104, whereas longitudinal movement of plunger 112 toward cam lobe 124 causes fuel flow into plunger bore 110, via inlet check valve 108, and creates an intake stroke which corresponds to a filling stroke 115. Extender element 114, spring retainer 116, tappet assembly 118, tappet return spring 120, plunger return spring 122 and cam lobe 124 are each housed within tappet bore 107 formed by housing 132 and are each disposed generally longitudinally below barrel 106.

In one embodiment, spring retainer 116 is spaced apart from barrel 106 and includes a guide diameter 119 structured to engage a portion of tappet return spring 120 such that a coil at one end of tappet return spring 120 may be disposed directly adjacent guide diameter 119 of spring retainer 116. In one aspect of this embodiment, guide diameter 119 may be a sidewall having an outer surface that engages a portion of tappet return spring 120. In another embodiment, extender element 114 is coupled to plunger 112 and includes a guide diameter 117 structured to engage a portion of plunger return spring 122 such that a coil at one end of plunger return spring 122 may be disposed directly adjacent guide diameter 117 of extender element 114. As described in more detail in the disclosed embodiment of FIGS. 3A and 3B, extender element 114 may also include a sidewall having an outer surface that engages a portion of plunger return spring 122. In various embodiments, guide diameter 117 and guide diameter 119 may be structured to have a specific fit to a first coil at one end of plunger return spring 122 and tappet return spring 120, respectively. In one embodiment of the present disclosure, guide diameter 117 may be equal to the spring inner diameter (ID) of plunger return spring 122 and may be structured for retainment onto a first coil of plunger return spring 122 via a slip or interference fit. Likewise, guide diameter 119 may be equal to the spring ID of tappet return spring 120 and may be structured for retainment onto a first coil of tappet return spring 120 via a slip or interference fit. Stated another way, in an exemplary embodiment, a first coil at one end of plunger return spring 122 may be engaged onto a guide diameter 117 that is slip or interference fit onto the first coil. Additionally, in various embodiments, tappet return spring 120 may provide a much larger spring force than plunger return spring 122. In one embodiment, tappet return spring 120 provides a spring force that is approximately 10×-20× larger than the spring force of plunger return spring 122. In one aspect of this embodiment, tappet return spring 120 provides a spring force sufficient to push approximately 100 lbs-200 lbs, while plunger return spring 122 provides a spring force sufficient to push approximately 10 lbs-20 lbs.

Pumping plunger 112 is driven in part by plunger return spring 122 cooperating with tappet assembly 118 to reciprocate plunger 112 within tappet bore 107 thereby causing pumping plunger 112 to move between an extended position and a retracted position during a filling stroke and a pumping stroke, respectively. A biasing member such as plunger return spring 122 applies a return force to pumping plunger 112 via extender element 114 to urge plunger 112 toward the extended position and into engagement with spring retainer 116 and tappet assembly 118. During normal operation of pumping element 102 tappet return spring 120 causes spring retainer 116 to contact tappet assembly 118 as tappet assembly moves in response to the rotation of the camshaft and its cam lobe 124. In the disclosed embodiment of FIG. 1, pumping plunger 112 of pumping element 102 is in the extended position, while pumping plunger 112 of pumping element 104 is in the retracted position.

In various embodiments of the present disclosure and as is described in further detail herein below, extender element 114 may cooperate with plunger return spring 122 to cause movement of pumping plunger 112 thereby urging plunger 112 out of seized interference within plunger bore 110. Plunger return spring 122 exerts a sufficiently strong spring force onto extender element 114 to urge one end of plunger 112 toward spring retainer 116 such that plunger 112 maintains contact with spring retainer 116 during operation of pumping element 102. As noted above, pumping plunger 112 may occasionally become stuck or seized within plunger bore 110. In one embodiment, the spring force provided by plunger return spring 122 may be sufficient to prevent the occurrence of a plunger seizure, while in another embodiment the spring force may be sufficient to mitigate the plunger seizure after a certain time period. For example, plunger 112 may experience a thermal seizure whereby excessively high operating temperatures within pumping element 100 causes plunger 112 to become seized within plunger bore 110. After a period of time, temperatures within pumping element 100 and plunger bore 110 may cool allowing extender element 114 to urge plunger 112 out of seized interference within plunger bore 110.

Figure 2A:
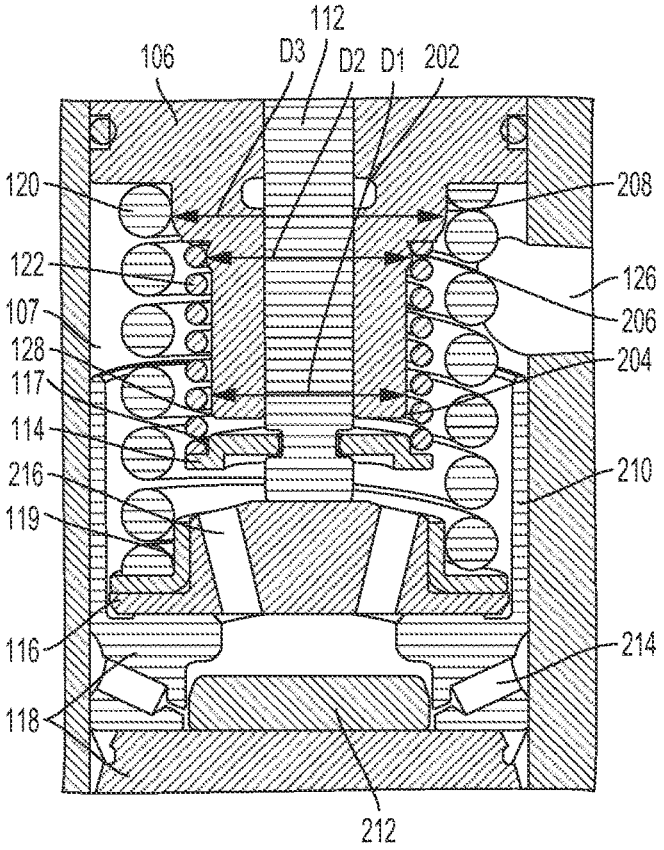
FIG. 2A is an enlarged cross-sectional view of an exemplary pumping element having an extended plunger according to the present disclosure.
Figure 2B:
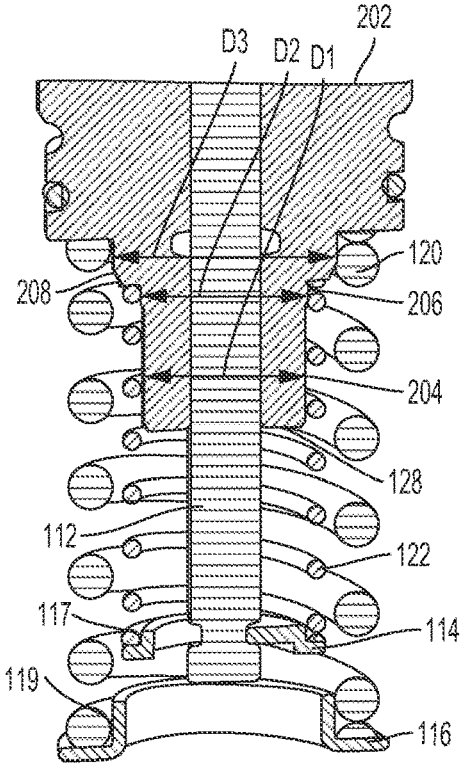
FIG. 2B is an enlarged cross-sectional view of an exemplary pumping element having an extended plunger according to the present disclosure.

FIG. 2A shows an enlarged cross-sectional view of pumping element 102 having a retracted pumping plunger 112 while FIG. 2B shows an enlarged cross-sectional view of pumping element 104 having an extended pumping plunger 112. The illustrative embodiments of FIGS. 2A and 2B include detailed illustrations of extender element 114, spring retainer 116, tappet assembly 118, tappet return spring 120, plunger return spring 122, vent-hole 126 and proximal end 128. The disclosed embodiment of FIGS. 2A and 2B may further include fuel-drain port 202, first barrel section 204, second barrel section 206, third barrel section 208 while the disclosed embodiment of FIG. 2A includes tappet shell 210, roller 212, fluid groove 214 and drain hole 216. As is known in the art, tappet assembly 118 may include a roller 212 rotatably secured to a section of tappet assembly 118. Tappet shell 210 may be a cup-shaped member that receives spring retainer 116 and at least a portion of tappet return spring 120. Tappet shell 210 may further receive extender element 114 during normal operation of pumping element 102 in which pumping plunger 112 is not seized within bore 110. In one embodiment, tappet assembly 118 includes fluid groove 214 configured to receive pressurized fluid such as engine oil which facilitates effective operation of roller 212 in the lower portion of tappet assembly 118. During operation of pumping element 102, oil may accumulate within tappet shell 210 due at least in part to the reciprocal movement of roller 212. As such, spring retainer 116 may include one or more drain holes 216 that are configured to drain oil back toward to roller 212.

As noted above, barrel 106 may include proximal end 128 and distal end 130. In the illustrative embodiment of FIGS. 2A and 2B, proximal end 128 includes first barrel section 204 having a first diameter D1, second barrel section 206 having a second diameter D2 and third barrel section 208 having a third diameter D3. In one embodiment, diameter D2 is greater than diameter D1 and diameter D3 is greater than diameter D2 and diameter D1. Additionally, first barrel section 204 and second barrel section 206 are configured to receive plunger return spring 122 such that at least one coil of plunger return spring 122 contacts second barrel section 206. Thus, first barrel section 204 and second barrel section 206 cooperate to provide a spring guide feature for plunger return spring 122. Likewise, third barrel section 208 is configured to receive a portion of the coils of tappet return spring 120 such that at least one coil of tappet return spring 120 contacts third barrel section 208. Hence, third barrel section 208 provides a spring guide feature for tappet return spring 120. As described above in the disclosed embodiment of FIG. 1, pressurized fuel fills a volume of space defined by pumping plunger 112 moving downwardly along longitudinal axis 105 while upward longitudinal movement of plunger 112 causes compression or pressurization of fuel in the volume of space and creates a pressure stroke (i.e. pumping stroke 113), which causes fuel to exit pumping element 102. During operation of pumping element 102, the reciprocal movement of plunger 112 within bore 110 may lead to pressurized fuel seeping into a small space that is in between bore 110 and plunger 112. As such, in one embodiment barrel 106 may include a fuel drain port 202 that is structured to drain excess pressurized fuel to a fuel tank of an internal combustion engine.

Figure 3A:
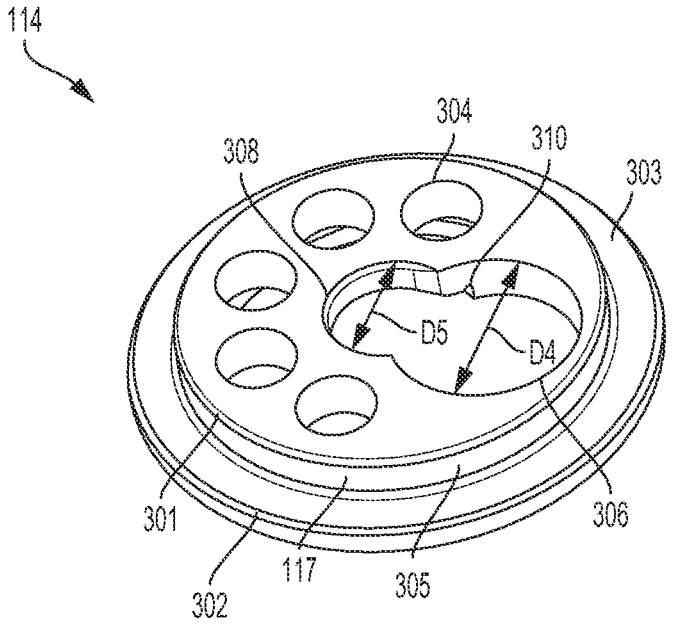
FIG. 3A is a first view of an extender element according to an exemplary embodiment of the present disclosure.
Figure 3B:
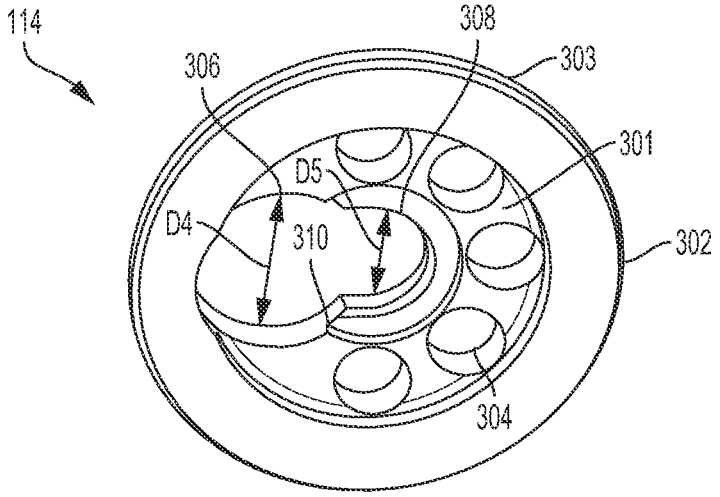
FIG. 3B is a second view of an extender element according to an exemplary embodiment of the present disclosure.
Figure 4A:
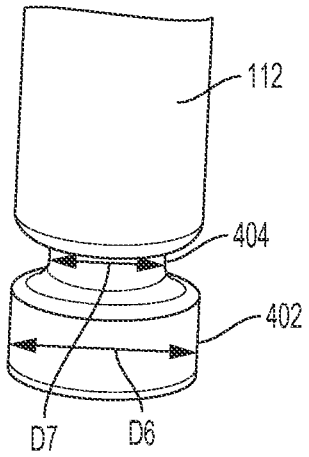
FIG. 4A is an enlarged view of a first end of an exemplary pumping plunger according to the present disclosure.
Figure 5:
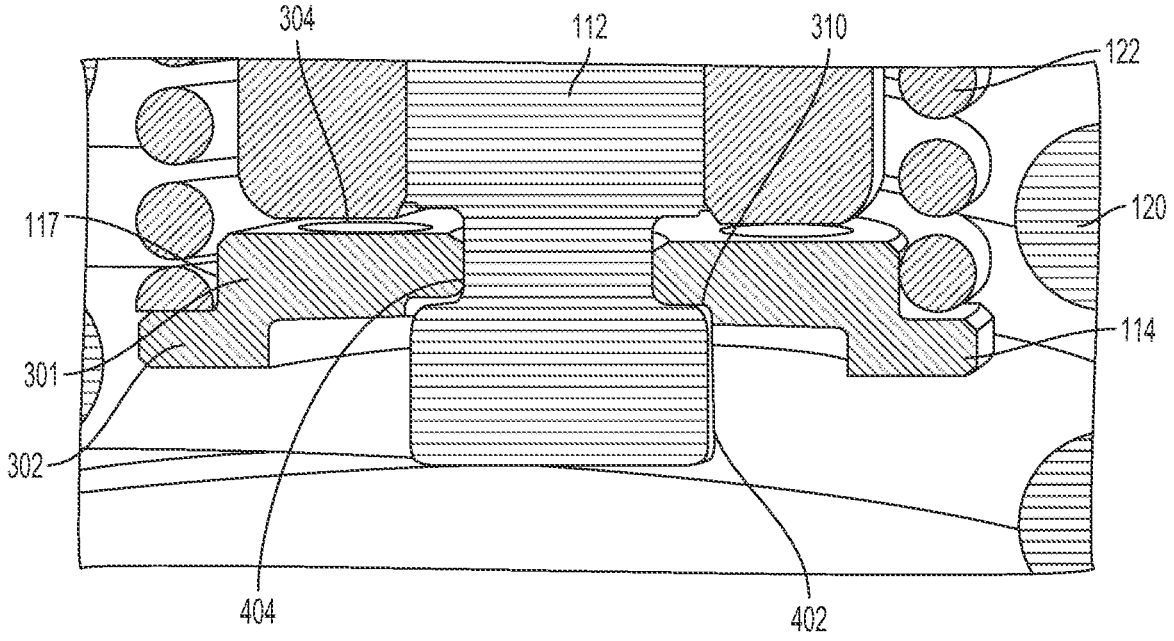
FIG. 5 is an enlarged cross-sectional view of an extender element coupled to a pumping plunger according to an exemplary embodiment of the present disclosure.

FIGS. 3A and 3B depict extender element 114. Extender element 114 includes mating section 301, disc section 302, surface 303, vent holes 304, sidewall 305, first slot 306, second slot 308 and counter-bore 310. First slot 306 and second slot 308 are disposed within mating section 301. As shown in FIG. 5, counter-bore 310 is structured to couple extender element 114 to pumping plunger 112 such that extender element 114 is retained on plunger 112 so as to not disengage from plunger 112 during operation of pumping element 102, 104. Additionally, surface 303 of disc section 302 functions as a spring retainer or spring seat and is engaged by plunger return spring 122. In one embodiment, surface 303 of disc section 302 is engaged by a first coil at an end of plunger return spring 122 while an outer surface of sidewall 305 guides one or more coils at the same end of plunger return spring 122. In one aspect of this embodiment, sidewall 305 may be perpendicular to surface 303 of disc section 302. As described above with reference to FIG. 1, in one embodiment, extender element 114 may include a guide diameter 117 structured to engage a portion of plunger return spring 122 such that a coil at one end of plunger return spring 122 may be disposed directly adjacent guide diameter 117 of extender element 114. Extender element 114 may include a plurality of vent holes 304 that are circularly arranged. In one embodiment, extender element 114 includes five or fewer vent holes 304. In another embodiment, extender element 114 includes five or more vent holes 304. Vent holes 304 are structured to reduce the pressurization and flow of fluid into bore 110 and into fuel drain port 202 during reciprocal movement of plunger 112. Stated another way, vent holes 304 permit equalization of fluid pressure on both sides of extender element 114 as pumping plunger 112 moves (along with extender element 114) to the retracted position. This pressure equalization reduces oil/fuel transfer into the space between plunger 112 and plunger bore 110. In one embodiment, first slot 306 may have a first diameter D4 and second slot 308 may have a second diameter D5 wherein first diameter D4 is larger than second diameter D5. Likewise, as shown in FIG. 4A, plunger 112 may include a first section 402 having a first diameter D6 and a second section 404 having a second diameter D7 wherein first diameter D6 is larger than second diameter D7. As discussed in more detail below, the diameters of first section 402 and second section 404 facilitate coupling of extender element 114 to plunger 112.

Figure 4B:
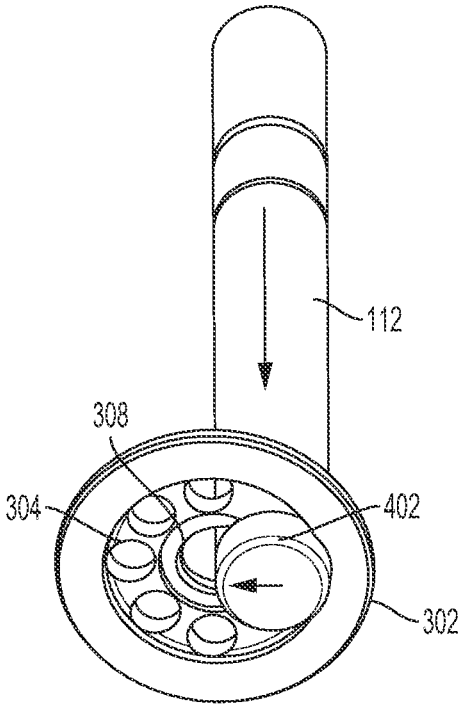
FIG. 4B shows a pumping plunger coupled to a first section of an extender element according to an exemplary embodiment of the present disclosure.
Figure 4C:
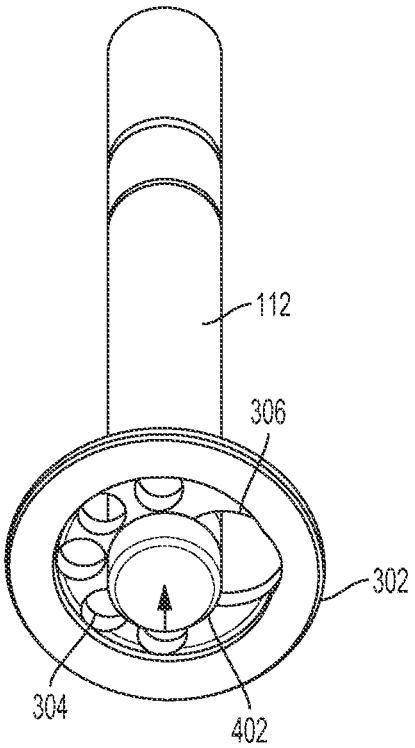
FIG. 4C shows a pumping plunger coupled to a second section of an extender element according to an exemplary embodiment of the present disclosure.
Figure 4D:
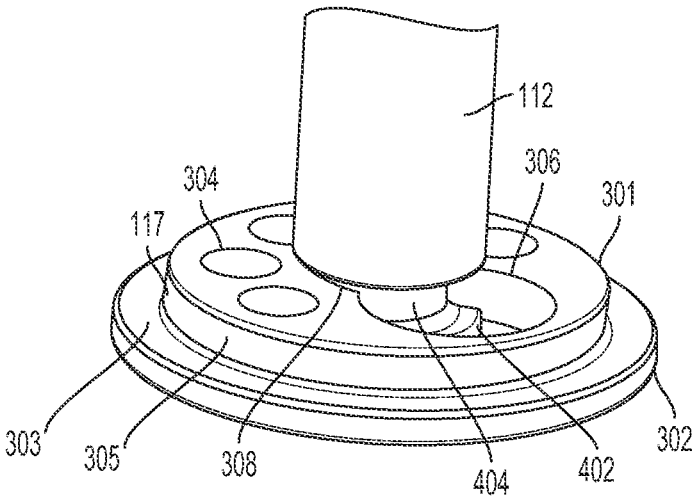
FIG. 4D shows a pumping plunger coupled to an extender element according to an exemplary embodiment of the present disclosure.

FIG. 4A-4D shows an exemplary pumping plunger such as plunger 112 being coupled to extender element 114. FIG. 4B shows first section 402 of pumping plunger 112 being received by first slot 306 of extender element 114. FIG. 4C shows second section 404 of pumping plunger 112 being received by second slot 308 of extender element 114. Lastly, as shown in FIG. 4C, plunger 112 may be moved slightly longitudinally upwardly such that extender element 114 is retained on second section 404 of plunger 112 via counter-bore 310. Hence, extender element 114 may be securely coupled to pumping plunger 112 via second slot 308 cooperating with second section 404 and counter-bore 310. Accordingly, FIG. 4D shows pumping plunger 112 coupled to extender element 114 via second slot 308 and counter-bore 310 according to an exemplary embodiment of the present disclosure.

Figure 6:
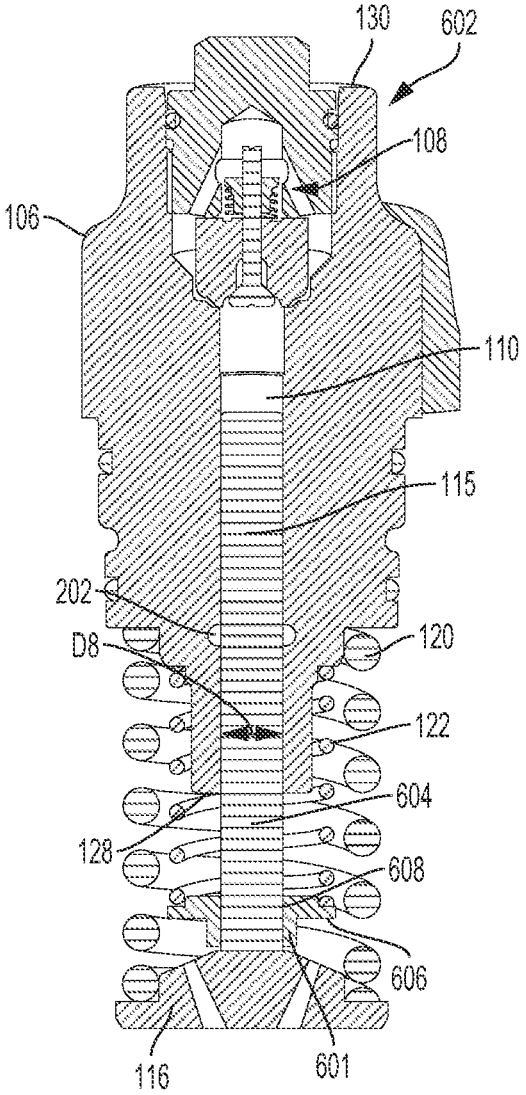
FIG. 6 is a cross-sectional view of an exemplary pumping element having an extended plunger according to the present disclosure.

FIG. 6 is a cross-sectional view of an exemplary pumping element 602 having an extended pumping plunger 604 and an extender element 606. In the disclosed embodiment of FIG. 6, pumping element 602 includes substantially the same components as pumping element 102 and 104 except that extender element 606 may include a single slot 608 disposed centrally within, for example, mating section 601. Single slot 608 may have a circular configuration and may be structured to facilitate coupling extender element 606 to pumping plunger 604. Unlike plunger 112, plunger 604 may have only a single section and having a uniform lengthwise diameter D8. In one embodiment, extender element 606 may be coupled to pumping plunger 604 via a press-fit and/or interference fit wherein single slot 608 of extender element 606 receives the single section of plunger 604 and coupling is facilitated by, for example, an interference fit resulting from diameter D8 of plunger 604 slightly exceeding a diameter of single slot 608 of extender element 606.

Figure 7:
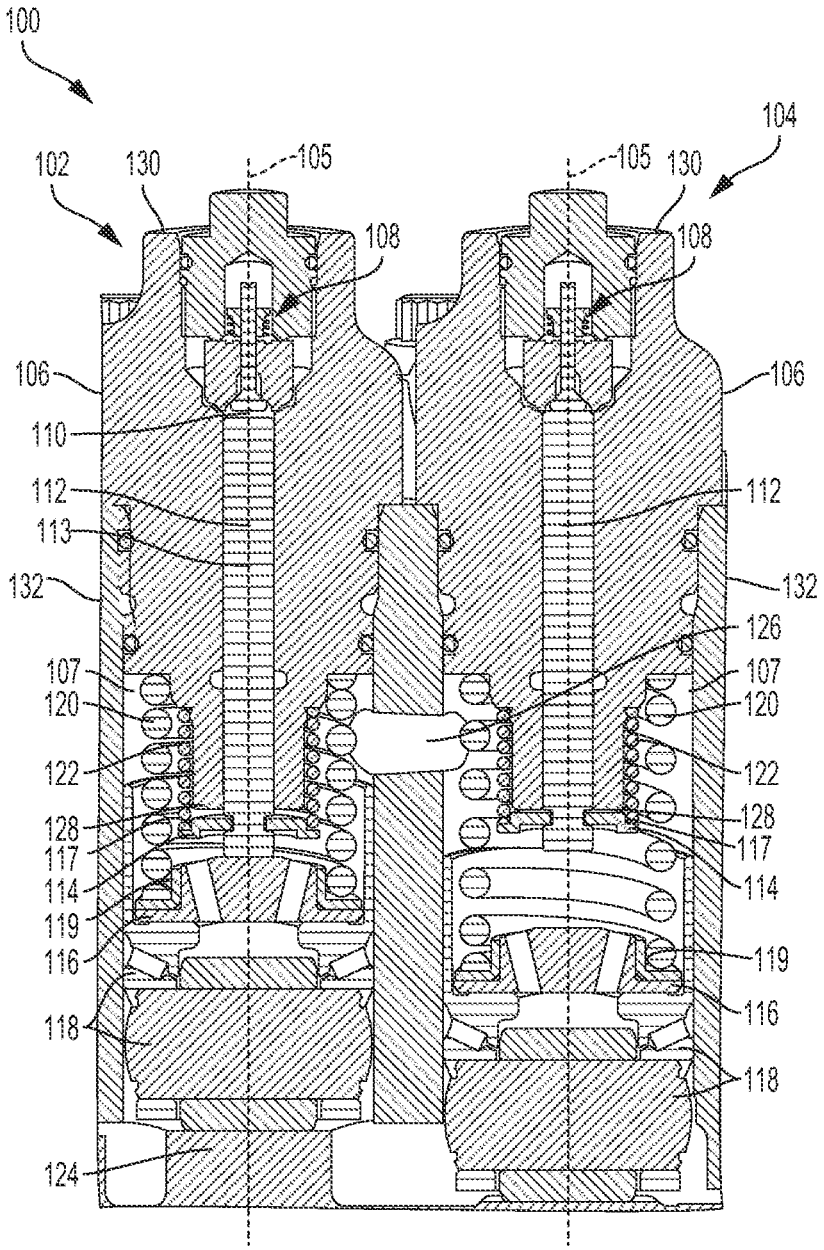
FIG. 7 is a cross-sectional view of exemplary pumping elements wherein one pumping element has a seized plunger according to an exemplary embodiment of the present disclosure.

FIG. 7 is a cross-sectional view of pumping elements 102, 104 wherein pumping element 104 has a seized plunger 112. As described above, pumping plungers are susceptible to seizure during high pressure pumping operations due to, for example, increased plunger thermal loads, debris build up within the bore which houses the plunger, or inadvertent side loading of the plunger. In FIG. 7, plunger 112 is shown seized while in the refracted position. In some prior designs a single coil spring similar to tappet return spring 120 was used in conjunction with a dual purpose retainer/extender element that provided tappet spring retainer functionality and plunger extension/extraction functionality. A plunger seizure in the prior designs sometimes damaged the pump. If this single spring provided insufficient force to move a seized plunger, then the tappet assembly (also driven by the spring) also remained in a retracted position and no longer followed the cam lobe. The damage occurred when the plunger unseized, the tappet assembly moved downwardly toward the cam lobe. As the cam rotated, the lobe slammed into the tappet assembly and caused damage.

The present disclosure provides a pumping element 102 that separates the plunger retraction function and the tappet preload function by, for example, adding an additional spring and an extender element which enables a seized plunger to un-seize and continue normal operation thereby avoiding progressive damage and engine downtime. As shown in FIG. 7, pumping plunger 112 is retracted by plunger return spring 122 cooperating with extender element 114 wherein the spring and extender functions are independent of tappet return spring 120. Such a design permits tappet return spring 120 to provide a spring force to tappet assembly 118 to ensure that tappet assembly 118 maintains contact with cam lobe 124 in a lower pumping element assembly such as tappet bore 107. Moreover, this design approach reduces concerns regarding roller tappet no-follow damage due to a seized plunger 112 and ensures tappet assembly 118 and cam lobe 124 remain in contact for all speeds and conditions during engine operation.

As described above, tappet assembly 118 reciprocates within tappet bore 107 which causes pumping plunger 112 to move between an extended position and a retracted position during a filling stroke and a pumping stroke, respectively. During normal operation, tappet return spring 120 and plunger return spring 122 expand as tappet assembly 118 moves in a longitudinally downward direction and compresses as tappet assembly 118 moves in a longitudinally upward direction. Expansion of plunger return spring 122 provides a downward spring force that pushes against extender element 114 causing plunger 112 to move an extended position and maintain contact with spring retainer 116 during normal pumping operation. When plunger 112 is in seized state (such as plunger 112 of element 104 in FIG. 7) due to, for example, a thermal seizure, tappet assembly 118 will continue to reciprocate upwardly and downwardly while pumping plunger 112 is seized. While plunger 112 is seized, plunger return spring 122 is attempting to expand thereby applying a downward spring force against extender element 114 to urge plunger 112 out of seized interference within plunger bore 110. Thus, plunger return spring 122 and extender element 114 urge a seized plunger 112 to un-seize and continue normal operation within fuel pump 100.

Figure 8:
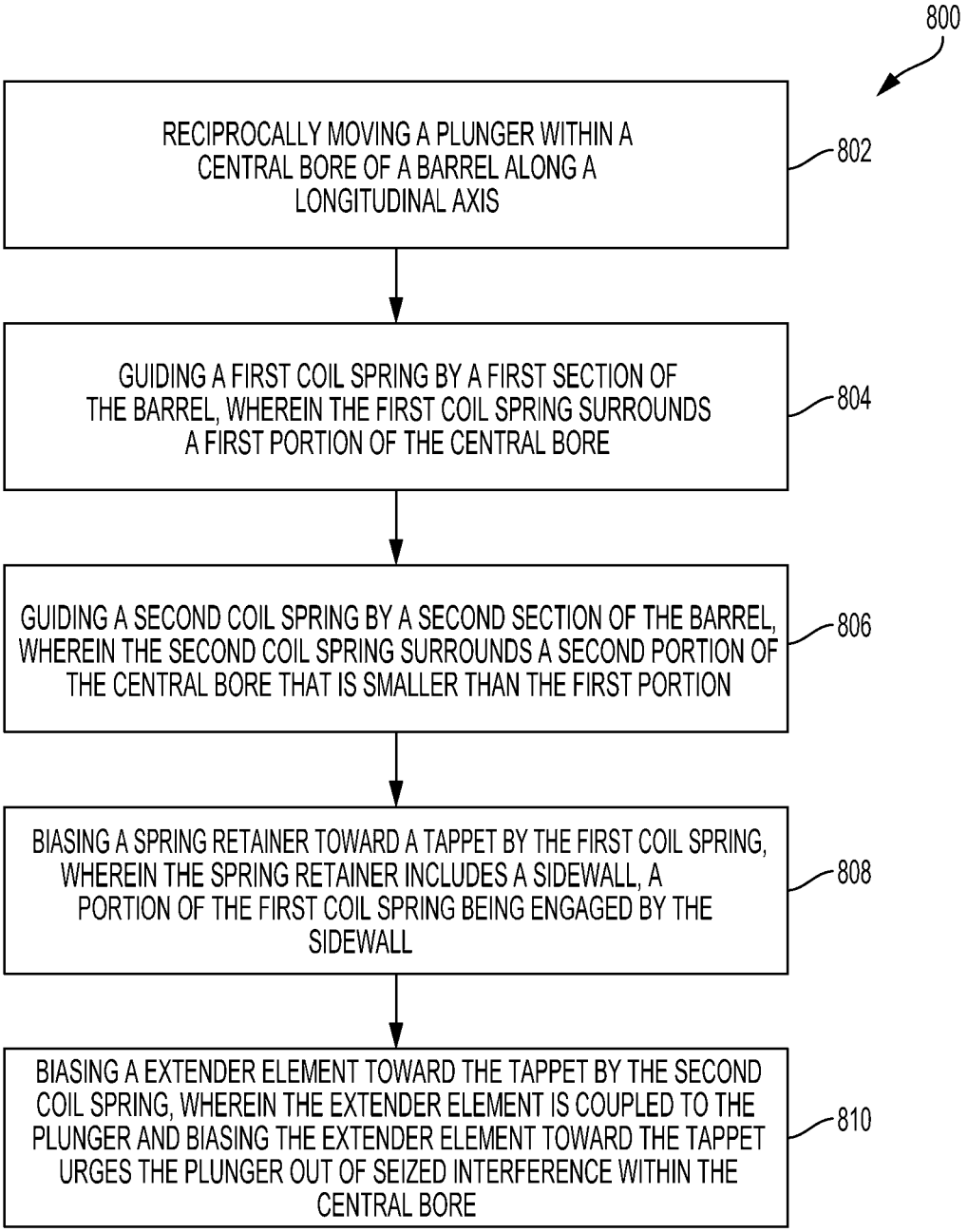
FIG. 8 shows a flow diagram of an exemplary method of the pumping element of FIG. 1.

FIG. 8 shows a flow diagram of an exemplary method of operating pumping element 102. At block 802 method 800 begins by reciprocally moving pumping plunger 112 within plunger bore 110 of barrel 106 along longitudinal axis 105. Method 800 then proceeds to block 804 wherein the block includes guiding tappet return spring 120 by, for example, third barrel section 208, wherein tappet return spring 120 surrounds a first portion of plunger bore 110. At block 806 method 800 includes guiding plunger return spring 122 by second barrel section 206, wherein plunger return spring 122 surrounds a second portion of plunger bore 110 that is smaller than the first portion. Method 800 then proceeds to block 808 wherein the method includes biasing spring retainer 116 toward tappet assembly 118 by tappet return spring 120, wherein spring retainer 116 includes a guide diameter 119, a portion of tappet return spring 120 being engaged by guide diameter 119. At block 810 method 800 includes biasing extender element 114 toward tappet assembly 118 by plunger return spring 122, wherein extender element 114 is coupled to pumping plunger 112 and biasing extender element 114 toward tappet assembly 118 urges pumping plunger 112 out of seized interference within plunger bore 110.

In the foregoing specification, specific embodiments of the present disclosure have been described. However, one of ordinary skill in the art will appreciate that various modifications and changes can be made without departing from the scope of the disclosure as set forth in the claims below. Accordingly, the specification and figures are to be regarded in an illustrative rather than a restrictive sense. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

The invention claimed is:

1. A fuel pump comprising:

a barrel including a central bore having a longitudinal axis, wherein the barrel comprises a first section and a second section along the longitudinal axis;

a plunger disposed partially in the central bore and movable along the longitudinal axis;

a spring retainer;

a first coil spring having a proximal end in contact with the first section of the barrel and a distal end in contact with the spring retainer to urge the spring retainer into engagement with a tappet assembly;

an extender element coupled to the plunger and disposed above the spring retainer; and a second coil spring having a proximal end in contact with the second section of the barrel and a distal end in contact with the extender element to urge the plunger toward the spring retainer, wherein the extender element includes a counter-bore to couple the extender element to the plunger, and wherein the first section of the barrel is above the second section of the barrel.

2. The fuel pump of claim 1, wherein the extender element includes a plurality of vent holes that are concentrically arranged, the vent holes structured to reduce flow of fluid into the central bore during reciprocal movement of the plunger.

3. The fuel pump of claim 2, wherein the extender element includes a first slot having a first diameter and a second slot having a second diameter, the first diameter being larger than the second diameter and the plunger includes a first section having a first diameter and a second section having a second diameter, the first diameter being larger than the second diameter.

4. The fuel pump of claim 3, wherein the first section of the plunger is received by the first slot of the extender element and the second section of the plunger is received by the second slot of the extender element such that the extender element is securely coupled to the plunger.

5. The fuel pump of claim 1, wherein the first section of the barrel has a first diameter and the second section of the barrel has a second diameter, the first diameter being larger than the second diameter, wherein at least one coil of the second coil spring contacts the second section.

6. The fuel pump of claim 5, wherein the barrel comprises a third section having a third diameter, the third diameter being smaller than the first diameter and the second diameter of the barrel, wherein at least one coil of the first coil spring contacts the first section and the at least one coil of the second coil spring contacts the third section.

7. The fuel pump of claim 5, wherein the extender element is coupled to the plunger via an interference fit.

8. The fuel pump of claim 1, further including at least a first pumping chamber and a second pumping chamber wherein an air vent is disposed intermediate the first and second pumping chambers.

9. A fuel pump comprising:

a barrel including a central bore having a longitudinal axis, wherein the barrel comprises a first section and a second section along the longitudinal axis;

a plunger disposed in the central bore and movable along the longitudinal axis;

a first coil spring guided by the first section of the barrel, wherein the first coil spring surrounds a first portion of the central bore;

a second coil spring guided by the second section of the barrel, wherein the second coil spring surrounds a second portion of the central bore that is smaller than the first portion, and wherein the first section of the barrel is above the second section of the barrel;

a spring retainer in contact with a tappet assembly, the spring retainer including a sidewall that engages a portion of the first coil spring; and an extender element coupled to the plunger and disposed above the spring retainer, the extender element including a sidewall that engages a portion of the second coil spring, wherein the extender element cooperates with the second coil spring to urge the plunger out of seized interference within the central bore.

10. The fuel pump of claim 9, wherein the extender element includes a counter-bore to couple the extender element to the plunger.

11. The fuel pump of claim 9, wherein the extender element includes a plurality of vent holes that are concentrically arranged, the vent holes structured to reduce flow of fluid into the central bore during reciprocal movement of the plunger.

12. The fuel pump of claim 9, wherein the extender element includes a first slot having a first diameter and a second slot having a second diameter, the first diameter being larger than the second diameter and the plunger includes a first section having a first diameter and a second section having a second diameter, the first diameter being larger than the second diameter.

13. The fuel pump of claim 12, wherein the first section of the plunger is received by the first slot of the extender element and the second section of the plunger is received by the second slot of the extender element such that the extender element is securely coupled to the plunger.

14. The fuel pump of claim 9, wherein the tappet assembly includes a tappet shell to receive the spring retainer, a plurality of coils of the first coil spring and a plurality of coils of the second spring, and the spring retainer includes at least two fluid drain passages to drain fluid towards a roller element partially disposed within the tappet assembly.

15. The fuel pump of claim 9, further including a fuel drain port to drain excess fuel to a fuel tank of an internal combustion engine in response to reciprocal movement of the plunger.

16. The fuel pump of claim 9, wherein the extender element further includes a disc section having a surface wherein the sidewall is perpendicular to the surface and the disc section is engaged by a portion of the second coil spring.

17. A method in a fuel pump comprising:

reciprocally moving a plunger within a central bore of a barrel along a longitudinal axis, wherein the barrel comprises a first section and a second section along the longitudinal axis;

guiding a first coil spring by the first section of the barrel, wherein the first coil spring surrounds a first portion of the central bore;

guiding a second coil spring by the second section of the barrel, wherein the second coil spring surrounds a second portion of the central bore that is smaller than the first portion, and wherein the first section of the barrel is above the second section of the barrel;

biasing a spring retainer toward a tappet by the first coil spring, wherein the spring retainer includes a sidewall, a portion of the first coil spring being engaged by the sidewall; and biasing an extender element toward the tappet by the second coil spring, wherein the extender element is coupled to the plunger and disposed above the spring retainer, and wherein biasing the extender element toward the tappet urges the plunger out of seized interference within the central bore.

18. The method of claim 17, further including, reducing, by a plurality of vent holes, the flow of fluid within the central bore during reciprocal movement of the plunger, wherein the plurality of vent holes are concentrically arranged within the extender element.

19. The method of claim 17, further including, draining, by a fuel drain port, excess fuel to a fuel tank of an internal combustion engine, wherein the draining occurs in response to reciprocal movement of the plunger.

20. The method of claim 17, further including, draining fluid towards a roller element partially disposed within the tappet, wherein the draining is enabled by at least two fluid drain passages disposed within the spring retainer.

21. A fuel pump comprising:

a barrel including a fuel drain port and a central bore having a longitudinal axis, wherein the barrel comprises a first section and a second section along the longitudinal axis, a plunger disposed partially in the central bore and movable along the longitudinal axis;

a spring retainer;

a first coil spring having a proximal end in contact with the first section of the barrel and a distal end in contact with the spring retainer to urge the spring retainer into engagement with a tappet assembly, and extender element coupled to the plunger and disposed above the spring retainer;

a second coil spring having a proximal end in contact with the second section of the barrel and a distal end in contact with the extender element to urge the plunger toward the spring retainer, wherein the extender element includes a counter-bore to couple the extender element to the plunger, and wherein an end of the plunger spaces the extender element apart from the spring retainer; and wherein the fuel drain port is configured to drain excess fuel in an interface between the plunger and the central bore that is along a length of the plunger.

* * * * *